US010321779B1

(12) United States Patent
Thai

(10) Patent No.: US 10,321,779 B1
(45) Date of Patent: Jun. 18, 2019

(54) MULTI-FUNCTION APPETIZER TRAY SYSTEM

(71) Applicant: Tony T. Thai, Huntington Beach, CA (US)

(72) Inventor: Tony T. Thai, Huntington Beach, CA (US)

( * ) Notice: Subject to any disclaimer, the term of this patent is extended or adjusted under 35 U.S.C. 154(b) by 0 days.

(21) Appl. No.: 15/975,612

(22) Filed: May 9, 2018

(51) Int. Cl.
*A47G 19/06* (2006.01)
*A47G 23/06* (2006.01)
*B65D 21/02* (2006.01)

(52) U.S. Cl.
CPC ..... *A47G 23/06* (2013.01); *A47G 19/06* (2013.01); *B65D 21/0235* (2013.01); *B65D 21/0238* (2013.01)

(58) Field of Classification Search
USPC ..... 206/557, 562, 563, 564, 565, 452, 493; 211/41.2, 4, 49.1, 59.1, 53, 54.1, 58
See application file for complete search history.

(56) References Cited

U.S. PATENT DOCUMENTS 3,025,948 A * 3/1962 Appelt ..... A47J 47/14 206/517
3,188,157 A * 6/1965 Rand ..... A45D 33/00 220/23.8
3,441,033 A * 4/1969 Flax ..... A45D 33/20 132/295
3,498,471 A * 3/1970 Dirkx ..... A47B 21/045 211/131.1
4,279,354 A 7/1981 Conti
4,356,952 A 11/1982 Rekow
4,516,685 A * 5/1985 French ..... A47G 19/06 206/563
4,560,078 A * 12/1985 Dubuisson ..... A45D 33/00 206/503
4,607,758 A * 8/1986 Stevens ..... A47G 19/06 206/509
4,752,146 A * 6/1988 Buckle ..... B43K 27/04 206/303
4,790,430 A * 12/1988 Thomas ..... B65D 21/0223 206/303
4,815,483 A * 3/1989 DuGrenier ..... A45D 33/00 132/295
4,867,330 A 9/1989 Venne
4,961,555 A * 10/1990 Egan, Jr. ..... A47G 23/0225 211/41.2
4,971,234 A * 11/1990 Hay ..... B25H 3/025 211/131.1
D331,860 S * 12/1992 Stanfield ..... B25H 3/023 D7/505
5,390,798 A * 2/1995 Yanuzzi ..... A47G 19/065 206/519

(Continued)

*Primary Examiner* — Jacob K Ackun
(74) *Attorney, Agent, or Firm* — Olav M. Underdal; IDP Patent Services

(57) ABSTRACT

A multifunction appetizer tray system includes a tray base including a base member and an upward protruding peg with a knob; a plurality of trays, each including a tray member with a serving area and a drinking glass holder, which is a cut out in the tray member, such that each tray can be attached to the peg with the drinking glass holder and rotated to a stored position, and such that the trays can be used as a personal appetizer plate with a stemmed drinking glass positioned in the drinking glass holder.

20 Claims, 6 Drawing Sheets

(56) References Cited

U.S. PATENT DOCUMENTS 5,419,455 A * 5/1995 Russeau ..... A47G 19/06 206/562
5,558,236 A 9/1996 Williams et al.
5,769,264 A * 6/1998 Lipkowitz ..... A47G 23/0625 220/23.83
5,797,495 A 8/1998 Lerrick
5,803,305 A * 9/1998 Perlis ..... A47G 19/065 206/558
6,021,914 A * 2/2000 Schmidt ..... A47G 19/06 220/23.83
6,223,921 B1 * 5/2001 Huang ..... A45C 11/24 132/295
6,619,297 B2 * 9/2003 Sheng ..... A45D 33/20 132/295
6,705,655 B2 * 3/2004 Yang ..... A47B 49/00 206/821
6,964,443 B1 * 11/2005 Newton ..... A47G 23/0208 206/217
D547,126 S * 7/2007 Levine ..... A47G 19/06 D7/549
7,543,869 B2 * 6/2009 Davis ..... A47G 19/065 206/563
7,997,410 B2 * 8/2011 Ali ..... B65D 73/0014 206/303
8,113,344 B2 * 2/2012 Arun ..... G11B 33/045 206/303
8,439,198 B2 * 5/2013 Hines ..... B65D 5/4208 206/146
8,915,391 B2 * 12/2014 Radow ..... A47G 19/00 108/139
8,985,379 B1 * 3/2015 Evans ..... A47J 45/00 206/562
9,877,586 B2 * 1/2018 Haenga ..... A47G 23/0216
9,926,954 B2 3/2018 Sortino et al.
9,980,589 B2 * 5/2018 Piccinini ..... A47G 23/0641
2003/0000903 A1 * 1/2003 Mondragon ..... A47F 5/02 211/144
2004/0154938 A1 * 8/2004 Chang ..... G11B 33/0444 206/308.1
2006/0032780 A1 2/2006 Heyn
2008/0264822 A1 * 10/2008 Faiola ..... A47G 19/06 206/561
2011/0198246 A1 * 8/2011 Avisar ..... B65B 5/10 206/216
2012/0138505 A1 * 6/2012 Raynor ..... A47G 19/06 206/564
2013/0233864 A1 9/2013 Kilpatrick
2014/0312195 A1 * 10/2014 Krzyzaniak ..... A47G 23/03 248/511
2016/0029803 A1 * 2/2016 Haenga ..... A47G 23/0216 248/205.2
2017/0224143 A1 8/2017 Daley

* cited by examiner

MULTI-FUNCTION APPETIZER TRAY SYSTEM

CROSS-REFERENCE TO RELATED APPLICATIONS

N/A.

FIELD OF THE INVENTION

The present invention relates generally to the field of serving trays, and more particularly to methods and systems for multi-function appetizer trays.

BACKGROUND OF THE INVENTION

Personal appetizer trays can be used at cocktail parties to allow guests to position appetizers while socializing.

However, storage of such appetizers trays is cumbersome, and guests often have problems holding both an appetizer tray and a drinking glass.

As such, considering the foregoing, it may be appreciated that there continues to be a need for novel and improved devices and methods for appetizer trays,

SUMMARY OF THE INVENTION

The foregoing needs are met, to a great extent, by the present invention, wherein in aspects of this invention, enhancements are provided to the existing model of appetizer trays, In an aspect, a multifunction appetizer tray system, can include:

a) a tray base, including:
  a base member; and
  a peg that protrudes upwards from the tray base; and
b) a plurality of trays, each tray including:
  a tray member, including:
    a serving area, which is an indentation of the tray member; and
  a stemmed drinking glass holder, which is a penetrating cutout in an inner end of the tray member, including:
    a passageway; and
    a central aperture;
    such that the passageway allows the peg to pass through the passageway into the central aperture, such that each tray is attached to the peg, such that the trays are stacked on top of the base member;
    such that the passageway allows a stem of a stemmed glass to pass through the passageway into the central aperture, such that a lower end of a drinking portion of the stemmed glass rests on a peripheral edge of the central aperture, when the tray member is removed from the tray base.

In a related aspect, an outer shape of each tray member in the plurality of trays can be similar to an outer shape of the base member, such that the trays are rotatable to a stowed position, such that the trays are aligned with the tray base.

In another related aspect, the plurality of trays can include four trays.

In yet a related aspect, the tray base can further include a knob, which is connected to an upper end of the peg, such that the trays can be stacked between the base member and the knob.

In yet another related aspect, the tray base can be configured to allow a height between the knob and the base member to be adjustable, such that tray members of the plurality of trays can be secured tightly in place between the base member and the knob when the height is reduced; and such that the tray members can be rotatable, while still attached to the peg, when the height is increased.

In yet a related aspect, the knob can further include a threaded bolt, and an outer end of the peg can include a threaded aperture, such that the threaded bolt can be threaded into the threaded aperture;

such that tray members of the plurality of trays can be secured tightly in place between the base member and the knob when the knob is tightened; and such that the tray members are rotatable, while still attached to the peg, when the knob is loosened.

In yet another related aspect, the knob further can further include a threaded aperture in an inner end of the knob, and an outer end of the peg can include threading, such that the peg is threaded into the threaded aperture; such that tray members of the plurality of trays are secured tightly in place between the base member and the knob when the knob is tightened; such that the tray members are rotatable, while still attached to the peg, when the knob is loosened.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
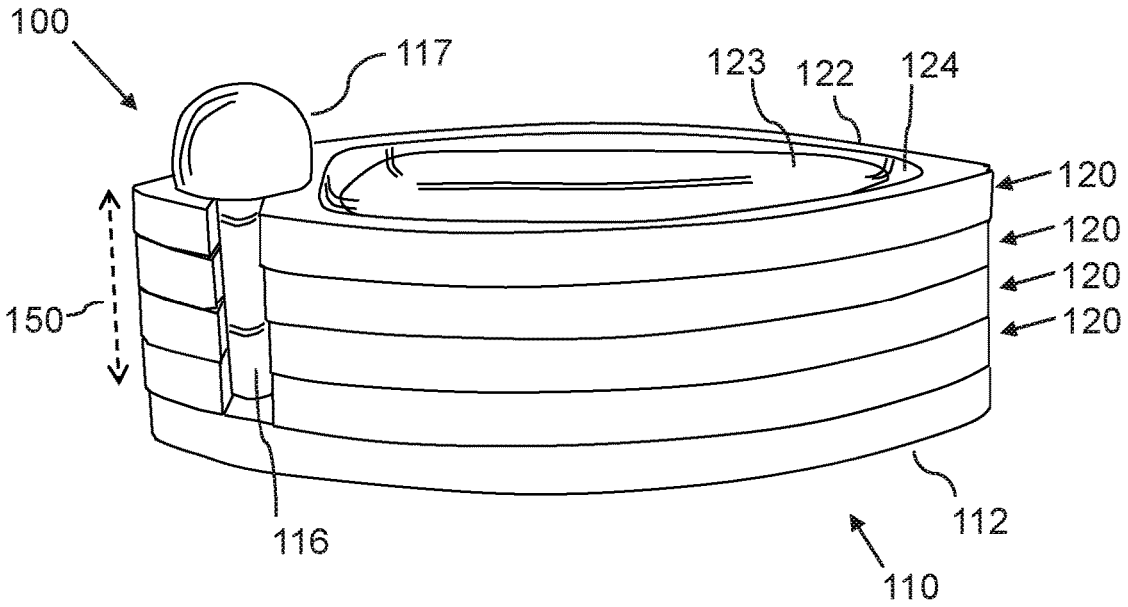
FIG. 1 is a perspective view of a multifunction appetizer tray system in a folded-up configuration, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a multifunction appetizer tray system 100 with reference to FIG. 1, in such manner that like reference numerals refer to like components throughout; a convention that we shall employ for the remainder of this specification.

Figure 2:
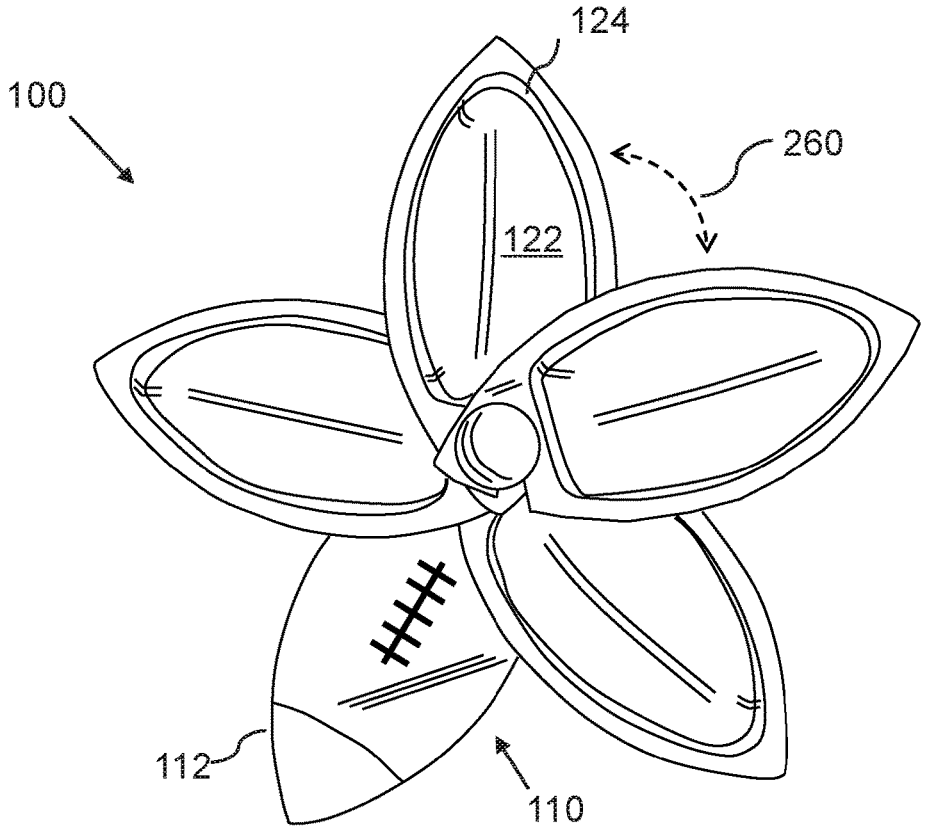
FIG. 2 is a top view of a multifunction appetizer tray system in a folded-out configuration, according to an embodiment of the invention.
Figure 3A:
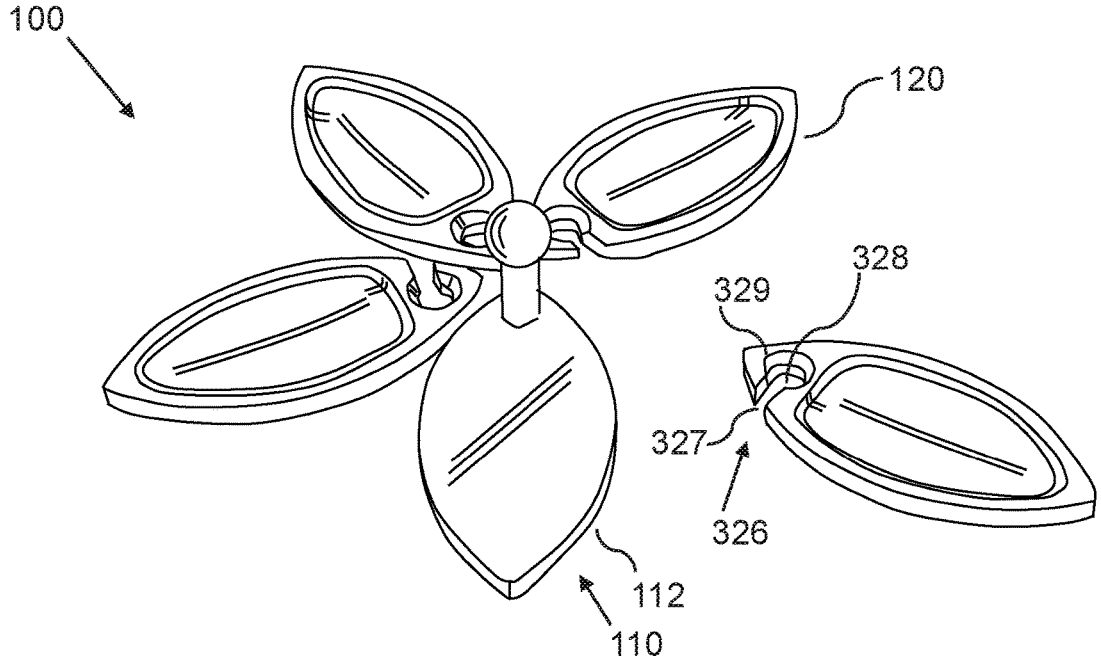
FIG. 3A is a perspective view of a multifunction appetizer tray system in a partially disassembled configuration, according to an embodiment of the invention.
Figure 3B:
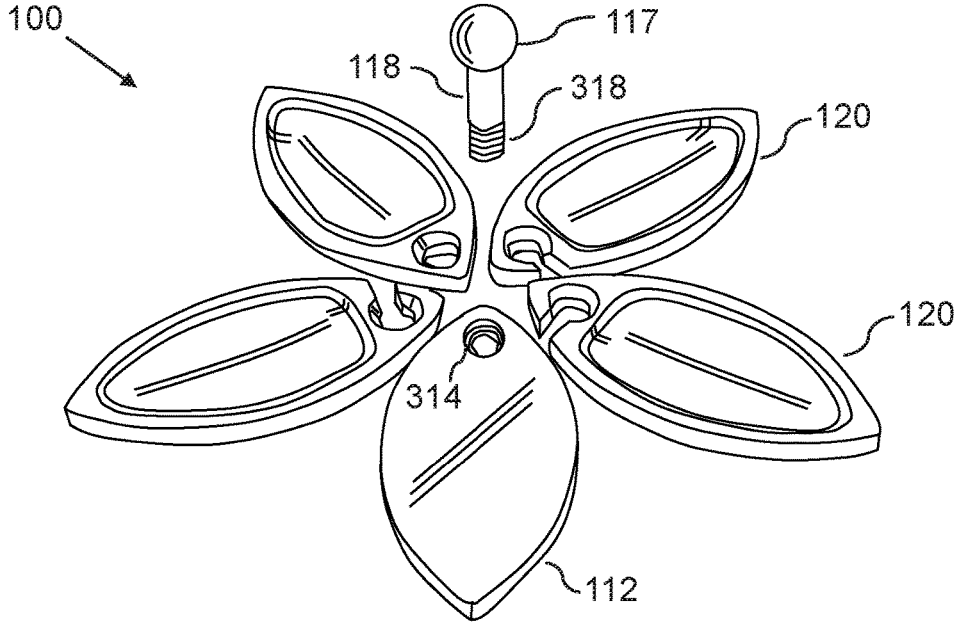
FIG. 3B is a perspective view of a multifunction appetizer tray system in a fully disassembled configuration, according to an embodiment of the invention.
Figure 5A:
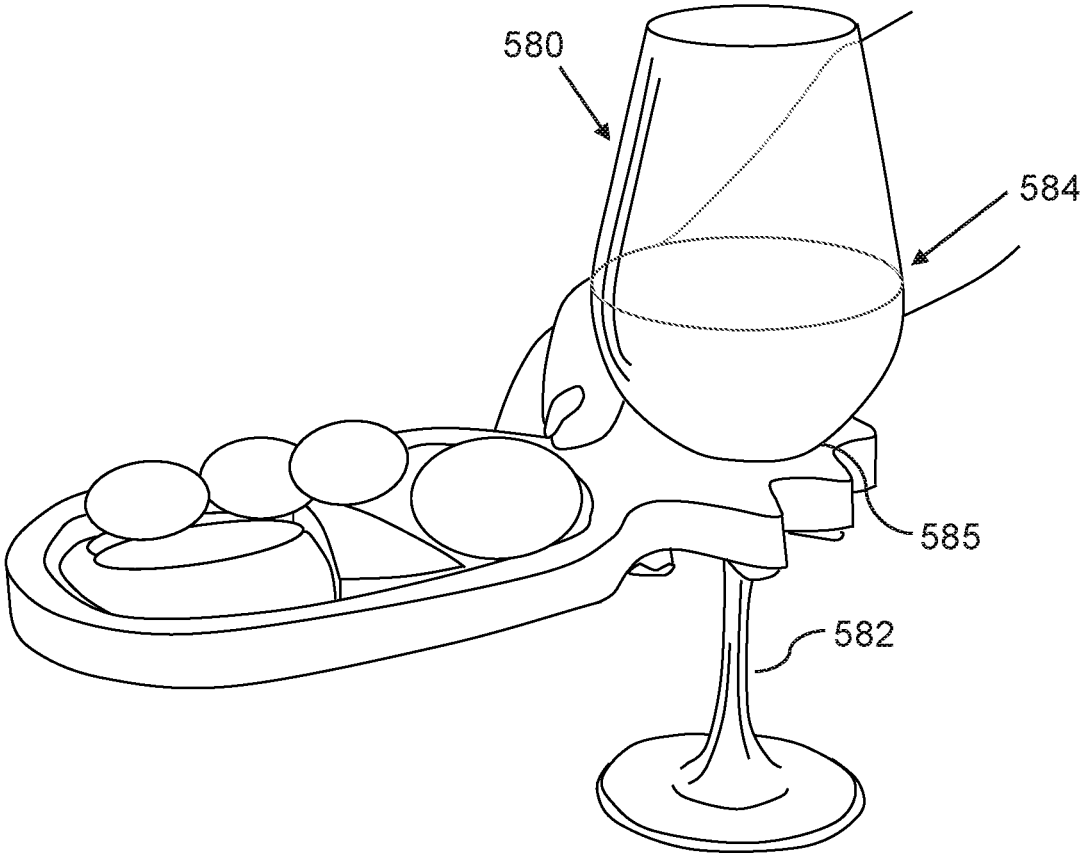
FIG. 5A is a perspective view of use of an appetizer tray of a multifunction appetizer tray system, according to an embodiment of the invention.
Figure 5B:
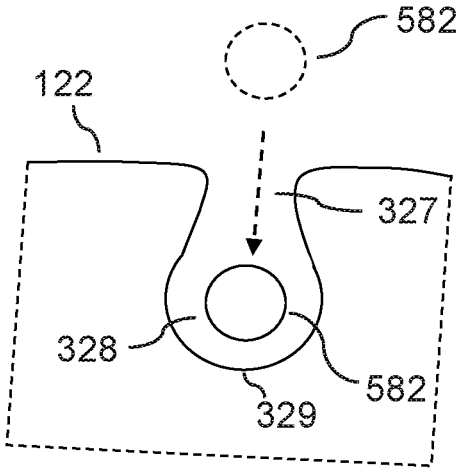
FIG. 5B is a top view of a part of a tray member of a multifunction appetizer tray system, according to an embodiment of the invention.

In an embodiment, as shown in FIGS. 1, 2, and 3, a multifunction appetizer tray system 100 can include:

a) a tray base 110, including:
   i. a base member 112 with a threaded aperture 314 in an inner end of the base member 112, as shown in FIG. 3B; and
   ii. a peg 116 with a knob 117 connected to an upper end of the peg 116, such that a threaded inner end of the peg 116 is connected to the threaded aperture 314, such that the peg 116 is perpendicularly connected to the base member 112, such that the peg 116 protrudes upwards; and b) a plurality of multifunction trays 120, each tray 120 including:
   i. a tray member 122, including:
      i. a serving area 123, which is an indentation of the tray member, which can include a peripheral wall 124, disposed on a periphery of the serving area 123; and
   ii. a stemmed drinking glass holder 326, as shown in FIG. 3A, which is a top-bottom penetrating cutout in an inner end of the tray member 122, including:
      ii. a passageway 327; and
      iii. a central aperture 328;

such that the passageway 327 allows the peg 116 to pass through the passageway 327 into the central aperture 328, such that each tray 120 can be attached to the peg 116, such that the trays 120 can be stacked (i.e. are configured to be stackable) on top of the base member 122, such that the trays 120 can be stacked between the base member 122 and the knob 117;

such that the passageway 327, as shown in FIGS. 3A and 5B, allows a stem 582 of a stemmed glass 580 to pass through the passageway 327 into the central aperture 328, such that a lower end 585 of a drinking/container portion 584 of the stemmed glass 580 can rest on a peripheral edge 329 of the central aperture 328, as shown in FIG. 3A, when the tray member 122 is removed from the tray base 110;

wherein an outer shape of each tray member 122 in the plurality of trays 120 is similar to an outer shape of the base member 110, such that the trays 120 can be rotated to a stowed position, such that the trays 120 can be aligned with the tray base 120, as shown in FIG. 1.

In a related embodiment, as shown in FIG. 1, the peg 116 can be tightened, such that tray members 122 of the plurality of trays are secured tightly in place between the base member 122 and the knob 117 when the peg 116 is tightened.

In a related embodiment, as shown in FIG. 2, the peg 116 can be loosened, such that tray members 122 of the plurality of trays 120 can be rotatable 260, while still attached to the peg 116, when the peg 116 is loosened; and such that, as shown in FIG. 3A, the trays 120 can be removed.

Figure 3C:
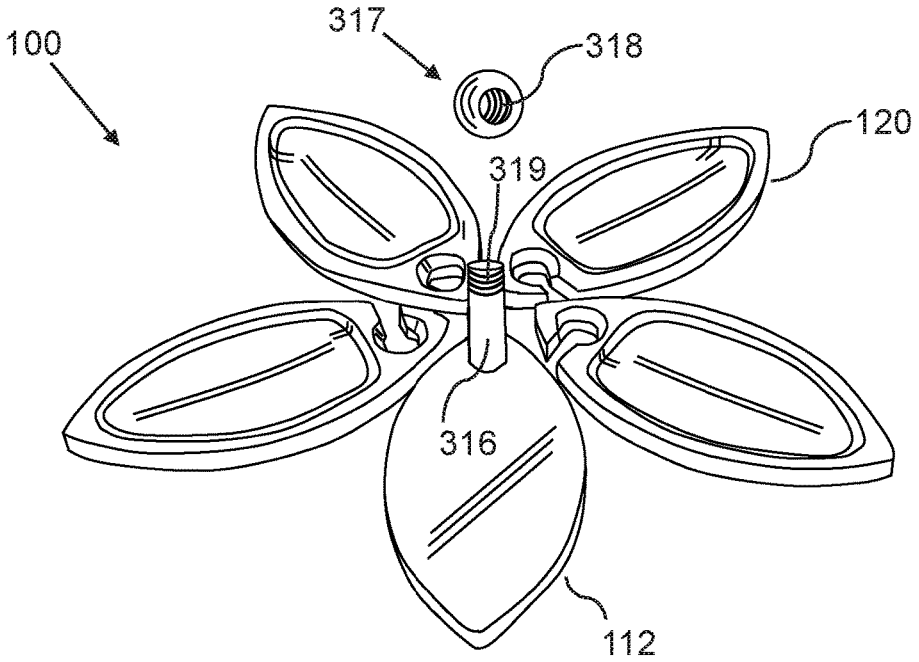
FIG. 3C is a perspective view of a multifunction appetizer tray system in a fully disassembled configuration, according to an embodiment of the invention.
Figure 3D:
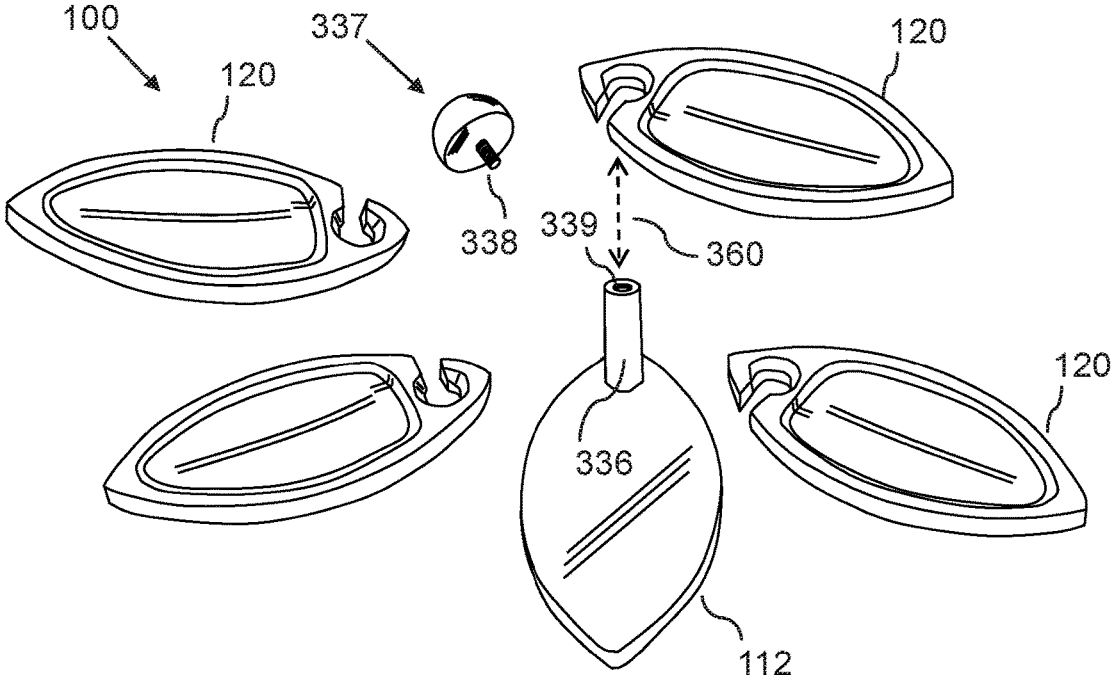
FIG. 3D is a perspective view of a multifunction appetizer tray system in a fully disassembled configuration, according to an embodiment of the invention.

In a related embodiment, as shown in FIGS. 3B, 3C, and 3D, the tray base 110 can be configured to allow a height 150 between the knob 117 and the base member 112 to be adjustable, such that tray members 122 of the plurality of trays 120 can be secured tightly in place between the base member 112 and the knob 117 when the height 150 is reduced; and such that the tray members 122 can be rotatable 260 (i.e. be allowed to rotate 260), while still attached to the peg, when the height is increased, and such that, as shown in FIGS. 3C and 3D, the trays 120 can be removed 360 by screwing the knob 317 337 off (i.e. removing the knob 317 337) and vertically sliding 360 the trays 120 off the peg 316 336.

Figure 4A:
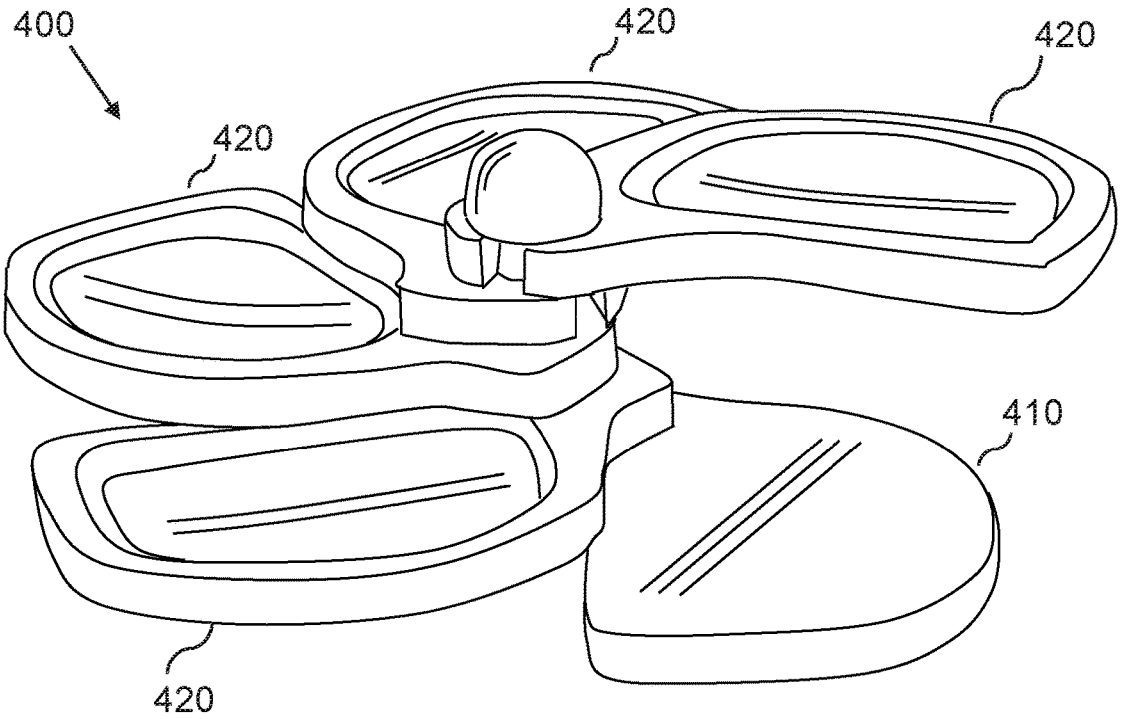
FIG. 4A is a perspective view of a multifunction appetizer tray system in a folded-out configuration, according to an embodiment of the invention.
Figure 4B:
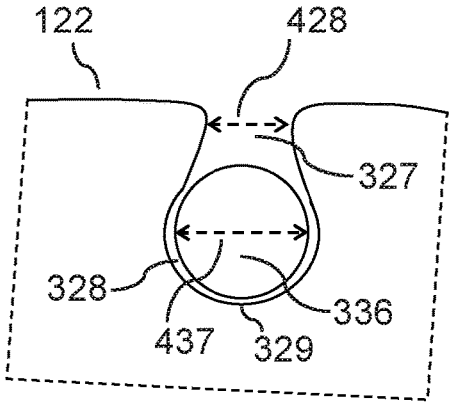
FIG. 4B is a top view of a part of a tray member of a multifunction appetizer tray system, according to an embodiment of the invention.

In a related embodiment, as shown in FIG. 4B, the central aperture 328 can be configured to accept/fit the peg 336, such that the tray 120 can slide vertically 360 onto the peg 336 with the peg sliding through the central aperture 328, such that the passageway 327 is configured with a width 428 that is narrower than a diameter 437 of the peg 336, such that the tray cannot accidentally slide horizontally off the peg 336, whereby the tray 120 can only be removed by removing the knob 317 337 and vertically sliding 360 the trays 120 off the peg 336.

Figure 6A:
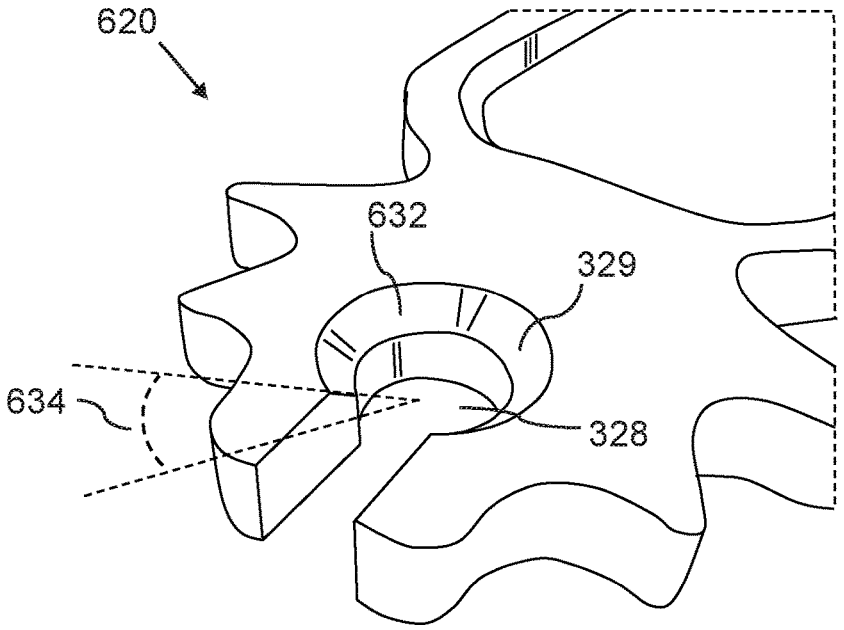
FIG. 6A is a perspective view of a part of a tray member of a multifunction appetizer tray system, according to an embodiment of the invention.
Figure 6B:
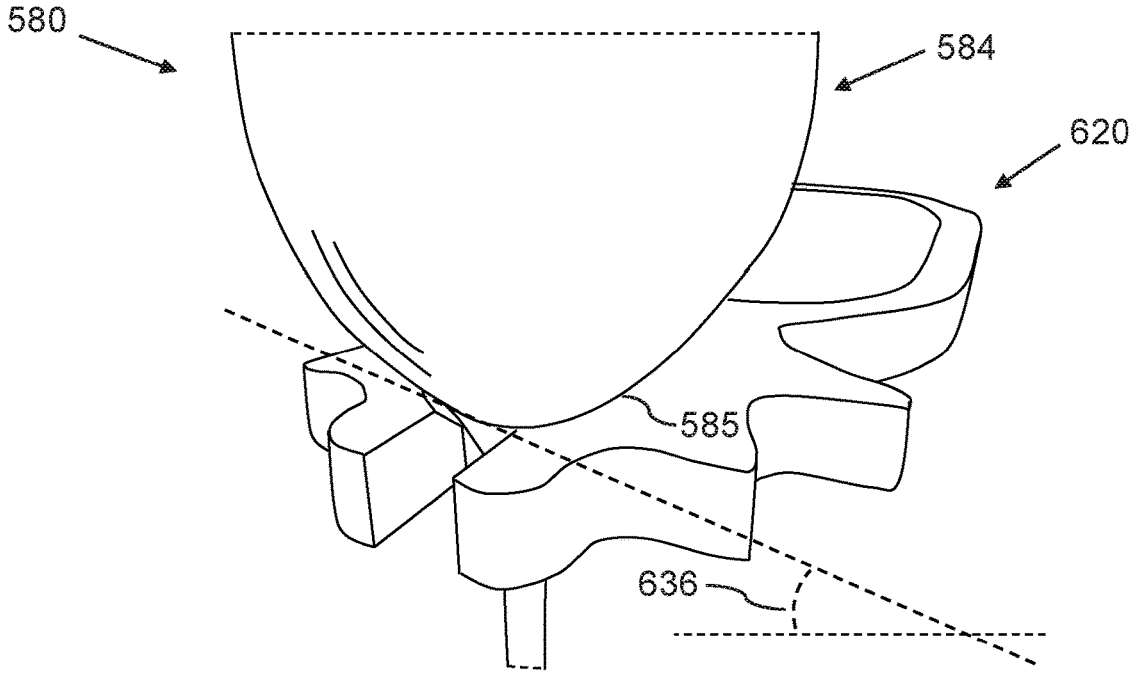
FIG. 6B is a perspective view of use of an appetizer tray of a multifunction appetizer tray system, according to an embodiment of the invention.

In yet a related embodiment, as shown in FIGS. 6A and 6B, the peripheral edge 329 of the central aperture 328 (of a tray 120 620) can be configured as a beveled edge 632 (i.e. such that the peripheral edge 329 is beveled/is a beveled edge 632), which is configured to support a lower end 585 of a drinking/container portion 584 of a stemmed glass 580 that is inserted into the central aperture 328, such that an edge angle 634 of the beveled edge 632 is configured to approximately/substantially match an external surface angle 636 of the lower end 585 of the drinking/container portion 584 that is in contact with the peripheral edge 329.

In another related embodiment, as shown in FIG. 3C, the knob 317 can include a threaded aperture 318 in an inner end of the knob 317, and an outer end of the peg 316 comprises threading 319, such that the knob 317 with the threaded aperture 318 can be threaded onto the threading 319 of the peg 316;

such that tray members 122 of the plurality of trays 120 are secured tightly in place between the base member 110 and the knob 317 when the knob 317 is tightened; such that the tray members 122 can be rotatable 260, while still attached to the peg 316, when the knob 317 is loosened. The peg 316 can in this embodiment be permanently glued into the base member 112.

In another related embodiment, as shown in FIG. 3D, the knob 337 can include a threaded bolt 338, which protrudes downward from an inner end of the knob 337, and an outer end of the peg 336 comprises a threaded aperture 339, such that the threaded bolt 338 can be threaded into the threaded aperture 339; such that tray members 122 of the plurality of trays 120 are secured tightly in place between the base member 110 and the knob 317 when the knob 317 is tightened; such that the tray members 122 can be rotatable 260, while still attached to the peg 316, when the knob 317 is loosened. The peg 336 can in this embodiment be permanently glued into the base member 112.

In related embodiment, the trays 120 420 and base members 110 410 can be manufactured in different uniform shapes, as shown in FIGS. 1 and 4A.

In another related embodiment, as for example shown in FIGS. 1 and 2, the plurality of trays 120 can include four trays. In other embodiments, there can be less than or more than four trays.

In a related embodiment, all parts of the multifunction appetizer tray system 100 can be made of wood, including rubberwood, cherry wood, and other wood types.

In a related embodiment, all parts of the multifunction appetizer tray system 100 can be made from wood, plastic, composites, metal, and combinations of these.

In related embodiment, the multifunction appetizer tray system 100 can have the following functions/features of utility:

a) Allows displays your favorite appetizers, Hors d' Oeuvres, desserts, cheeses, fruits on kitchen countertops or dining tables without cumbersome display trays;
b) Perfect for mingling at parties, conveniently holds both your wine glass and appetizer;
c) Stemmed wine glass fits into the built-in holder;
d) Prepared for easy, space saving storage when not in use;
e) Useful for any entertaining function, and makes serving and presenting food easy;
f) Compact, edged appetizer plate holds wine and appetizers in one convenient unit, with raised perimeter edge to prevent appetizers from shifting;
g) Easy to maintain and clean. Can be washed with warm soapy water and air dried;
h) Multifunctional as a five-tiered food display stand, and as individual appetizer plates;
i) Allows for unscrewing and removal of the knob to remove plates and use them as appetizer plates; and
j) Wine glass stem holders are cleverly designed on the ends of the plates, making it easy to hold both wine and food while mingling.

Here has thus been described a multitude of embodiments of the multifunction appetizer tray system 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A multifunction appetizer tray system, comprising:
a) a tray base, comprising:
a base member; and
a peg, such that the peg is connected to the tray base, such that the peg protrudes upwards;
b) a stemmed glass, comprising a stem and a drinking portion; and
c) a plurality of trays, each tray comprising:
a tray member, comprising:
a serving area, which is an indentation of the tray member; and
a stemmed drinking glass holder, which is a penetrating cutout in an inner end of the tray member, the stemmed drinking glass holder comprising:
a passageway; and
a central aperture;
such that each tray is attached to the peg, such that the trays are stacked on top of the base member;
such that the passageway is configured to allow the stem of the stemmed glass to pass through the passageway into the central aperture, such that a lower end of the drinking portion of the stemmed glass rests on a peripheral edge of the central aperture, when the tray member is removed from the tray base;
wherein the peripheral edge of the central aperture is configured as a beveled edge, which is configured to contact and support the lower end of the drinking portion of the stemmed glass; and
wherein an edge angle of the beveled edge is configured to match an external surface angle of the lower end of the drinking portion that is in contact with the peripheral edge.

2. The multifunction appetizer tray system of claim 1, wherein an outer shape of each tray member in the plurality of trays is similar to an outer shape of the base member, such that the trays are rotatable to a stowed position, such that the trays are aligned with the tray base.

3. The multifunction appetizer tray system of claim 1, wherein the plurality of trays comprises four trays.

4. The multifunction appetizer tray system of claim 1, wherein the tray base further comprises a knob, which is connected to an upper end of the peg, such that the trays are stacked between the base member and the knob.

5. The multifunction appetizer tray system of claim 4, wherein the tray base is configured to allow a height between the knob and the base member to be adjustable, such that the tray members of the plurality of trays are secured tightly in place between the base member and the knob when the height is reduced; and
such that the tray members are rotatable, while still attached to the peg, when the height is increased.

6. The multifunction appetizer tray system of claim 5, wherein the knob further comprises a threaded bolt, and an outer end of the peg comprises a threaded aperture, such that the threaded bolt is threaded into the threaded aperture;

such that tray members of the plurality of trays are secured tightly in place between the base member and the knob when the knob is tightened; and such that the tray members are rotatable, while still attached to the peg, when the knob is loosened.

7. The multifunction appetizer tray system of claim 5, wherein the knob further comprises a threaded aperture in an inner end of the knob, and an outer end of the peg comprises threading, such that the knob is threaded onto the threading of the peg;

such that tray members of the plurality of trays are secured tightly in place between the base member and the knob when the knob is tightened; and such that the tray members are rotatable, while still attached to the peg, when the knob is loosened.

8. The multifunction appetizer tray system of claim 5, wherein the peg further comprises a threaded aperture in an inner end of the peg, and an inner end of the base member comprises a threaded aperture, such that the peg is threaded into the threaded aperture;

such that tray members of the plurality of trays are secured tightly in place between the base member and the knob when the peg is tightened; and such that the tray members are rotatable, while still attached to the peg, when the peg is loosened.

9. The multifunction appetizer tray system of claim 1, wherein the tray member further comprises a peripheral wall disposed on a periphery of the serving area.

10. The multifunction appetizer tray system of claim 4, wherein the knob is configured to be removable, such that a tray in the plurality of trays is removable by screwing the knob off and vertically sliding the tray off the peg.

11. The multifunction appetizer tray system of claim 1, wherein the passageway is configured with a width that is narrower than a diameter of the peg.

12. A multifunction appetizer tray system, comprising:

a) a tray base, comprising:

a base member; and a peg, such that the peg is connectable to the tray base, such that the peg protrudes upwards; and b) a plurality of trays, each tray comprising:

a tray member; and a stemmed drinking glass holder, which is a penetrating cutout in an inner end of the tray member, comprising:

a passageway, wherein the passageway is configured with a width that is narrower than a diameter of the peg, such that the trays when attached to the peg cannot slide horizontally off the peg, whereby the trays can only be removed by vertically sliding the trays off the peg; and a central aperture;

such that each tray is attachable to the peg, such that the trays are configured to be stackable on top of the base member;

such that the passageway is configured to allow a stem of a stemmed glass to pass through the passageway into the central aperture, such that a lower end of a drinking portion of the stemmed glass rests on a peripheral edge of the central aperture when the tray member is removed from the tray base.

13. The multifunction appetizer tray system of claim 12, wherein an outer shape of each tray member in the plurality of trays is similar to an outer shape of the base member, such that the trays are rotatable to a stowed position, such that the trays are aligned with the tray base when the trays are attached to the peg.

14. The multifunction appetizer tray system of claim 12, wherein the tray base further comprises a knob, which is connected to an upper end of the peg, such that the trays are stacked between the base member and the knob.

15. The multifunction appetizer tray system of claim 14, wherein the tray base is configured to allow a height between the knob and the base member to be adjustable, such that tray members of the plurality of trays are secured tightly in place between the base member and the knob when the height is reduced; and such that the tray members are rotatable, while still attached to the peg, when the height is increased.

16. The multifunction appetizer tray system of claim 14, wherein the knob further comprises a threaded bolt, and an outer end of the peg comprises a threaded aperture, such that the threaded bolt is threaded into the threaded aperture;

such that, when the plurality of trays are attached to the peg, tray members of the plurality of trays are secured tightly in place between the base member and the knob when the knob is tightened; and such that the tray members are rotatable, while still attached to the peg, when the knob is loosened.

17. The multifunction appetizer tray system of claim 14, wherein the knob further comprises a threaded aperture in an inner end of the knob, and an outer end of the peg comprises threading, such that the knob is threaded onto the threading of the peg;

such that, when the plurality of trays are attached to the peg, tray members of the plurality of trays are secured tightly in place between the base member and the knob when the knob is tightened; and such that the tray members are rotatable, while still attached to the peg, when the knob is loosened.

18. The multifunction appetizer tray system of claim 12, wherein the tray member further comprises a serving area, which is an indentation of the tray member; and a peripheral wall, which is disposed on a periphery of the serving area.

19. The multifunction appetizer tray system of claim 12, wherein all parts of the multifunction appetizer tray system are made of wood.

20. A multifunction appetizer tray system, comprising:

a) a tray base, comprising:

a base member; and a peg, such that the peg is connectable to the tray base, such that the peg protrudes upwards;

b) a stemmed glass, comprising a stem and a drinking portion; and c) a plurality of trays, each tray comprising:

a tray member; and a stemmed drinking glass holder, which is a penetrating cutout in an inner end of the tray member, comprising:

a passageway; and a central aperture;

such that each tray is attachable to the peg, such that the trays are configured to be stackable on top of the base member;

such that the passageway is configured to allow the stem of the stemmed glass to pass through the passageway into the central aperture, such that a lower end of the drinking portion of the stemmed glass rests on a peripheral edge of the central aperture when the tray member is removed from the tray base;

wherein the peripheral edge of the central aperture is configured as a beveled edge, which is configured to contact and support a lower end of the drinking portion of the stemmed glass; and wherein an edge angle of the beveled edge is configured to match an external surface angle of the lower end of the drinking portion that is in contact with the peripheral edge.

* * * * *